United States Patent [19]

Brinson

[11] Patent Number: 5,029,372

[45] Date of Patent: Jul. 9, 1991

[54] SHOELACE FOR CHILDREN

[76] Inventor: Betty L. Brinson, 950 N. Minnesota St., Carson City, Nev. 89703

[21] Appl. No.: 421,768

[22] Filed: Oct. 16, 1989

[51] Int. Cl.[5] ..... A43C 9/00

[52] U.S. Cl. ..... 24/715.4; 87/9; 57/224

[58] Field of Search ..... 24/715.4; 87/6, 9; 57/224

[56] References Cited

U.S. PATENT DOCUMENTS

| | | | |
|---|---|---|---|
| 422,131 | 2/1890 | James | 24/715.4 X |
| 576,056 | 1/1897 | Kempshall | 24/715.4 |
| 1,644,529 | 10/1927 | Hunter | 87/6 |
| 2,030,160 | 2/1936 | Titcomb | 87/9 X |
| 2,335,088 | 11/1943 | Shoemaker | 87/9 X |
| 3,486,409 | 12/1969 | Powell | 87/6 |
| 4,547,426 | 10/1985 | Montle | 87/6 X |

FOREIGN PATENT DOCUMENTS

| | | | |
|---|---|---|---|
| 27203 | of 1903 | United Kingdom | 24/715.4 |

*Primary Examiner*—Laurie K. Cranmer

*Attorney, Agent, or Firm*—Milton S. Gerstein

[57] ABSTRACT

An improved shoelace with an inner core of copper wire strands encased in a cover of clear polyvinylchloride, which is contained in an outer jacket or casing of polypropylene fiber. When the shoelace of the invention is threaded through a shoe and then tied into a bow, it retains its shape and does not become untied by itself. The bow may also twisted, turned, or otherwise shaped so as to further prevent the untying of the shoe by the fact of the retention of that shape by means of the inner core of twisted copper strands.

2 Claims, 1 Drawing Sheet

SHOELACE FOR CHILDREN

BACKGROUND OF THE INVENTION

The present invention is directed to an improved shoelace specifically for children, which shoelace retains its shape and does not become untied during the normal play and vigorous routine of children It is well-known that prior-art shoelaces, whether for adults or children, are prone to becoming untied, which is an especial problem occurring with children, necessitating continued retying of the laces by the child or parent, or the like. It is the objective of the present invention to provide an improved shoelace for children that will not become untied by itself, but only when it is desired for such untying to occur.

SUMMARY OF THE INVENTION

The improved shoelace of the invention is provided, in the preferred embodiment, with an inner core of copper wire strands encased in a cover of clear polyvinylchloride, which is contained in an outer jacket or casing of polypropylene fiber. When the shoelace of the invention is threaded through a shoe and then tied into a bow, it retains its shape and does not become untied by itself. The bow may also be twisted, turned, or otherwise shaped so as to further prevent the untying of the shoe by the fact of the retention of that shape by means of the inner core of twisted copper strands. To untie the shoelace, one merely pulls on one of the free ends of the shoelace and pulls it, in the conventional manner, or one may also undo the shape to place the bow into its original shape, after which it is untied in the conventional manner by pulling on one of the ends of the lace.

BRIEF DESCRIPTION OF THE DRAWING

The invention will be more readily understood with reference to the accompanying drawing, wherein.

DETAILED DESCRIPTION OF THE INVENTION

Figure 1:
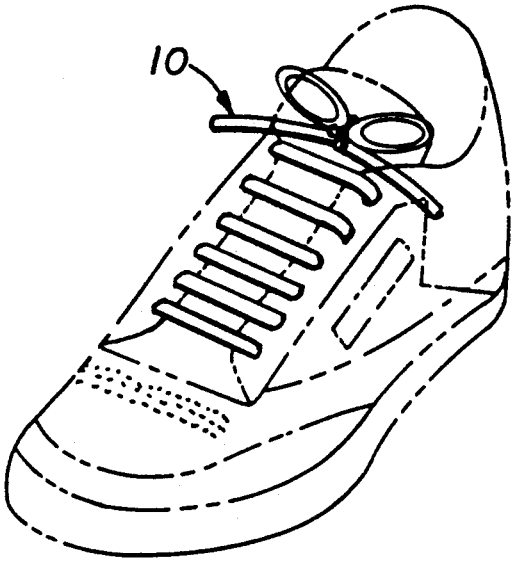
FIG. 1 is a perspective view showing the shoelace of the invention laced in a shoe and tied.
Figure 2:
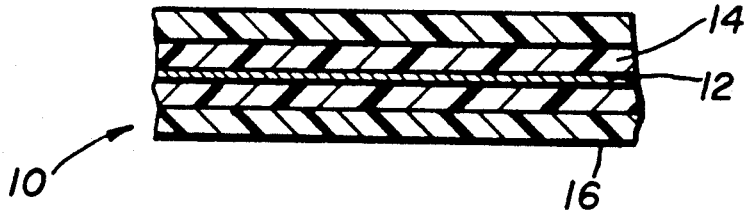
FIG. 2 is a cross-sectional view of the shoelace of the invention of the preferred embodiment showing the three separate sections thereof.

Referring now to the drawing in greater detail, the shoelace of the invention is indicated generally by reference numeral 10. In the preferred embodiment, the shoelace 10 is comprised of three separate and distinct sections: An inner core 12 made of a plurality of individual copper wires or strands; a second, intermediate core 14 made of clear polyvinylchloride (PVC) surrounding and encasing the inner copper-wire core; and a third, outer casing or jacket 16 made of polypropylene fiber. In the preferred embodiment, the inner cooper-wire core 12 is made up of copper wire strands of between #12 to #22 gauge, with #18 copper wire being the most preferred. For the middle or intermediate section 16, PVC is the most preferred material, and serves to provide slipless, high-friction contact between the outer core 16 and the inner core made up of sections 12 and 14. Without the intermediate section 14, there may be a tendency for the copper wire strands to slip relative to the outer fiber-jacket. The outer core of most preferably made of polypropylene fibers of between 200–2600 denier. However, nylon may be used in the range of between 240–3120 denier, or 20% more, and, in addition, polyester may be used in the range of 300–3900, or 50% more than the polypropylene fiber. Preferably, 4.5 cord, 1600 denier polypropylene fiber is used for the outer jacket, the 4.5 indicating the outer diameter of 4.5/32 of an inch. It is, of course, possible to use other materials than those described. The copper-wire core may be replaced with other metallic strands or wire, or the like, that will hold and retain its shape to which it has been shaped. The shoelace of the invention holds its shape by virtue of the inner copper-wire core, which helps to prevent the shoelace from untying. The outer jacket 16 offers high frictional contact, so that, coupled with the inner copper-wire core causing the shoelace to retain its shape, there is little chance of the shoelace becoming untied by accident. The core is optimally used to allow for the shoelace, after tying, to be twisted or shaped into a retentive form, which increases the surface-to-surface contact of the outer jacket surface portions, thereby increasing the total friction needed to be overcome in order to accidentally untie the shoelace. Even in an untwisted or unshapen form, with just the conventional single-knot with bow, the inner retentive core 12 will help prevent the accidental untying of the shoelace owing to the general shape of the bow itself and the fact that the shoelace will retain its shape because of the inner copper-wire core. Untying occurs when the knot and bow-shape are altered or changed from their original shape by external factors. If the bow and knot tend to keep their shape, there is less tendency for untying. The inner layer 12 is embedded in the intermediate layer 14 by well-known techniques, such as those by which electrical lamp-cords are made. In addition, each end of the shoelace is also preferably provided with outer, telescoping, short clear plastic sleeves by which the shoelace may be threaded through the holes of the shoe. The outer jacket is braided onto the combined inner-intermediate cores by a conventional diamond-braiding machine.

While a specific embodiment of the invention has been shown and described, it is to be understood that numerous changes and modifications may be made therein without departing from the scope, spirit and intent of the invention as set forth in the appended claims.

What I claim is:

1. A shoelace for a shoe, comprising:

an inner core made of a flexible material that is bendable and also shape-retentive;

an outer jacket surrounding and encasing said inner core;

an intermediate core in which said inner core is embedded, said outer core surrounding and encasing said intermediate core; said intermediate core being made of polyvinylchloride;

said inner core being made of a bundle of separate metallic wire strands having a size of being between 12 and 22 gauge;

said outer jacket being made of fiber material of at least one of polypropylene fibers of between 200–2600 denier, nylon fibers between 240–3120 denier, and polyester fibers between 300–3900 denier.

2. In a shoelace for a shoe, comprising:

an inner core, an intermediate core, and outer jacket surrounding and encasing said intermediate core, the improvement comprising:

said intermediate core being made of polyvinyl-chloride;

said inner core being made of a bundle of separate metallic wire strands having a size of being between 12 and 22 gauge;

said outer jacket being made of fiber material of at least one of polypropylene fibers of between 200–2600 denier, nylon fibers between 240–3120 denier, and polyester fibers between 300–3900 denier.

* * * * *